US006346153B1

(12) United States Patent
Lake et al.

(10) Patent No.: US 6,346,153 B1
(45) Date of Patent: Feb. 12, 2002

(54) WET OR DRY WEB DISPENSER

(75) Inventors: Andrew M. Lake, Combined Locks; Richard J. Kamps, Rightstown, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/245,506

(22) Filed: Feb. 5, 1999

Related U.S. Application Data

(60) Provisional application No. 60/112,751, filed on Dec. 17, 1998.

(51) Int. Cl.[7] ..... B05C 3/00

(52) U.S. Cl. ..... 118/423; 118/419; 118/428; 118/429

(58) Field of Search ..... 118/419, 420, 118/428, 429, 423, 122, DIG. 17; 206/233, 204; 221/33, 45; 242/593

(56) References Cited

U.S. PATENT DOCUMENTS

| | | | | |
|---|---|---|---|---|
| 603,316 | A | 5/1898 | Bush | |
| 2,308,168 | A | 1/1943 | Garson | 91/46 |
| 2,322,552 | A | 6/1943 | Sweetland | 91/14 |
| 2,789,725 | A | 4/1957 | Carper | 221/56 |
| 3,025,829 | A | 3/1962 | Smith | 118/221 |
| 3,084,664 | A | 4/1963 | Perlman et al. | 118/235 |
| 3,104,183 | A | 9/1963 | Mancebo | 118/230 |
| 3,199,490 | A | 8/1965 | Karlik | 118/43 |
| 3,310,353 | A | 3/1967 | Cordis | 312/39 |
| 3,363,604 | A | 1/1968 | Pschibul | 118/212 |
| 3,368,522 | A | 2/1968 | Cordis | 118/43 |
| 3,388,953 | A | 6/1968 | Browning | 312/39 |
| 3,460,509 | A | 8/1969 | Kaczeus | 118/41 |
| 3,609,263 | A | 9/1971 | Clementi | 220/60 R |
| 3,613,966 | A | 10/1971 | Summers | 222/529 |
| 3,707,945 | A | 1/1973 | Boone | 118/234 |

(List continued on next page.)

FOREIGN PATENT DOCUMENTS

| | | | |
|---|---|---|---|
| DE | 3412069 A1 | 3/1985 | A47K/10/34 |
| DE | 3409905 A1 | 9/1985 | A47K/10/38 |
| GB | 887478 | 1/1962 | |
| GB | 1370633 | 10/1974 | A47K/10/34 |
| GB | 2045722 A | 11/1980 | A47K/10/32 |
| GB | 2168031 A | 6/1986 | B65H/75/00 |
| WO | WO 88/04150 | 6/1988 | A47K/10/32 |

OTHER PUBLICATIONS

Derwent Wold Patent Database abstract of DE 4243408 A: Description of A. Dursun, "Toilet "paper"holder with damping arrangement."

*Primary Examiner*—Brenda A. Lamb
(74) *Attorney, Agent, or Firm*—Gregory E. Croft; Michael J. Bendel

(57) ABSTRACT

An easily operated dispenser for a flexible web typically a cellulosic web is provided that can be operated at a user option to provide a dry web or provide a liquid treated web. The liquid treatment can comprise an antimicrobial liquid treatment suitable for personal contact. The liquid treatment can comprise a cleaner, a soothing lotion, a protective coating, a pharmaceutical treatment, or any other liquid that can provide a beneficial property to a skin surface. The dispenser operates by having a first position from which it provides a dry web. The dispenser can also have a second position which contacts the web with a liquid treatment producing a web containing the liquid treatment composition. The user can interact with the dispenser and place the dispenser in the second position or the first position depending on the user's need for either a wet or dry web. This is a self-contained unit which can be designed to be either a disposable or nondisposable unit. The container can fit into a conventional tissue roll bracket or it can be designed to sit in a flat surface.

19 Claims, 3 Drawing Sheets

U.S. PATENT DOCUMENTS

Figure 6A:
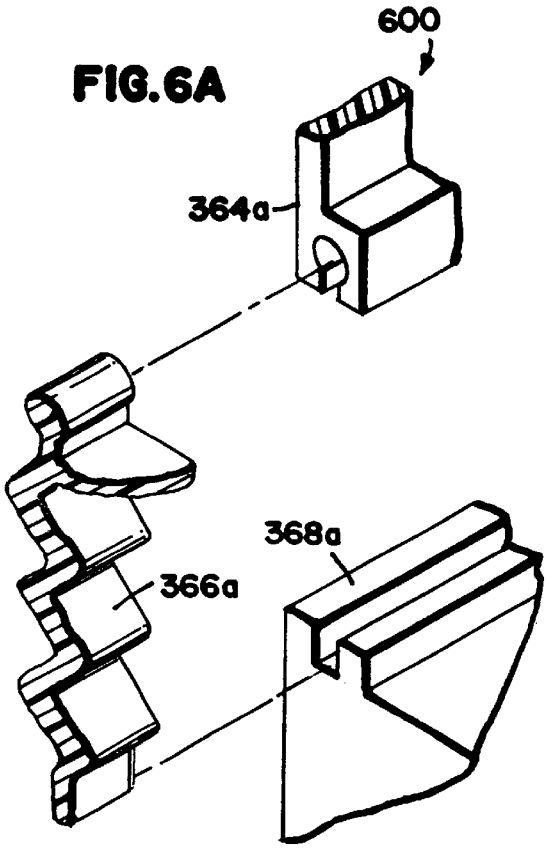

| | | | | | |
|---|---|---|---|---|---|
| 3,771,883 | A | | 11/1973 | Terepin | 401/123 |
| 3,775,801 | A | | 12/1973 | Walker | 15/104.93 |
| 3,796,185 | A | | 3/1974 | Boone | 118/325 |
| 3,824,953 | A | | 7/1974 | Boone | 118/75 |
| 3,837,595 | A | | 9/1974 | Boone | 242/55.3 |
| 3,910,229 | A | | 10/1975 | Spencer | 118/43 |
| 3,995,582 | A | | 12/1976 | Douglas | 118/43 |
| 4,004,687 | A | | 1/1977 | Boone | 206/233 |
| 4,017,002 | A | | 4/1977 | Doyle et al. | 221/63 |
| 4,041,900 | A | * | 8/1977 | Charles | 118/419 |
| 4,106,433 | A | | 8/1978 | Fernando et al. | 118/212 |
| 4,106,616 | A | | 8/1978 | Boone | 206/233 |
| 4,106,617 | A | | 8/1978 | Boone | 206/233 |
| 4,185,754 | A | | 1/1980 | Julius | |
| 4,235,333 | A | | 11/1980 | Boone | 206/233 |
| 4,328,907 | A | | 5/1982 | Beard | 221/63 |
| 4,337,876 | A | | 7/1982 | Thompson | 221/36 |
| 4,488,640 | A | | 12/1984 | Leung | 206/229 |
| 4,566,606 | A | | 1/1986 | Kling | 221/25 |
| 4,620,502 | A | | 11/1986 | Kimble | 118/419 |
| 4,667,846 | A | | 5/1987 | Marceau | 221/34 |
| 4,747,365 | A | | 5/1988 | Tusch | 118/221 |
| 4,913,312 | A | | 4/1990 | Boutin | 221/45 |
| 4,971,220 | A | | 11/1990 | Kaufman et al. | 220/335 |
| 4,978,095 | A | | 12/1990 | Phillips | 248/312 |
| 4,981,557 | A | | 1/1991 | Bjorkquist | 162/168.2 |
| 4,991,538 | A | | 2/1991 | Davids et al. | 118/231 |
| 5,085,736 | A | | 2/1992 | Bjorkquist | 162/168.2 |
| 5,088,344 | A | | 2/1992 | Anderson et al. | 74/572 |
| 5,242,057 | A | | 9/1993 | Cook et al. | 206/581 |
| 5,311,986 | A | | 5/1994 | Putz | 206/233 |
| 5,387,284 | A | | 2/1995 | Moody | 118/220 |
| 5,399,412 | A | | 3/1995 | Sudali et al. | 428/153 |
| 5,429,686 | A | | 7/1995 | Chiu et al. | 139/383 A |
| 5,439,521 | A | | 8/1995 | Rao | 118/415 |
| 5,443,084 | A | | 8/1995 | Saleur | 134/58 R |
| 5,462,197 | A | | 10/1995 | Pound | 221/46 |
| 5,540,332 | A | | 7/1996 | Kopacz et al. | 206/494 |
| 5,607,551 | A | | 3/1997 | Farrington, Jr. et al. | 162/109 |
| 5,672,248 | A | | 9/1997 | Wendt et al. | 162/109 |
| D385,707 | S | | 11/1997 | Kopacz et al. | D5/53 |
| 5,765,717 | A | | 6/1998 | Gottselig | |

* cited by examiner

FIG. 1
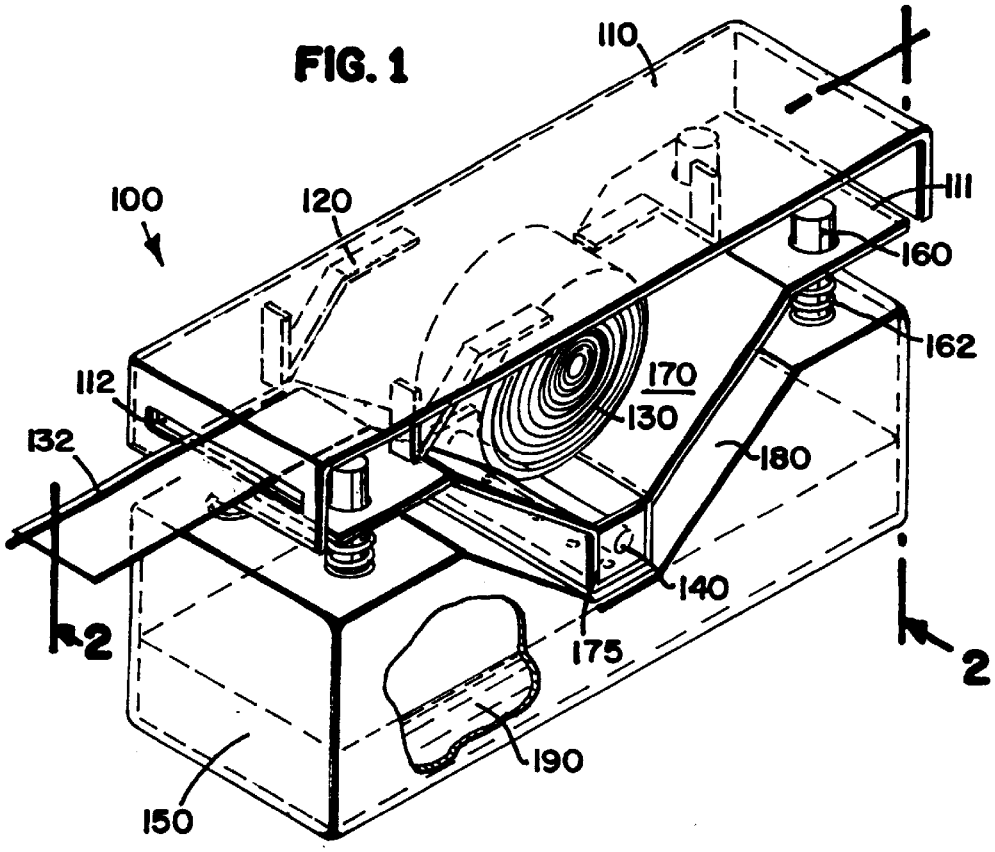
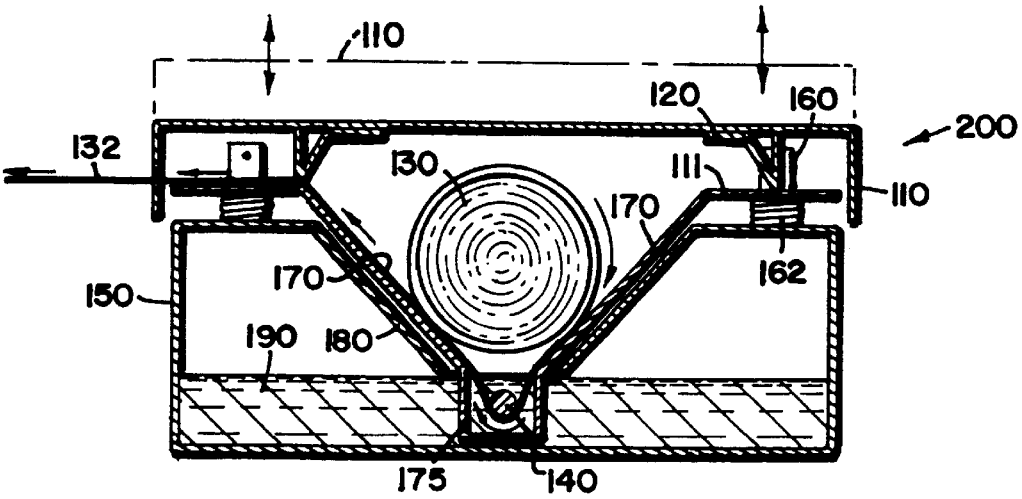
FIG. 2

FIG. 3
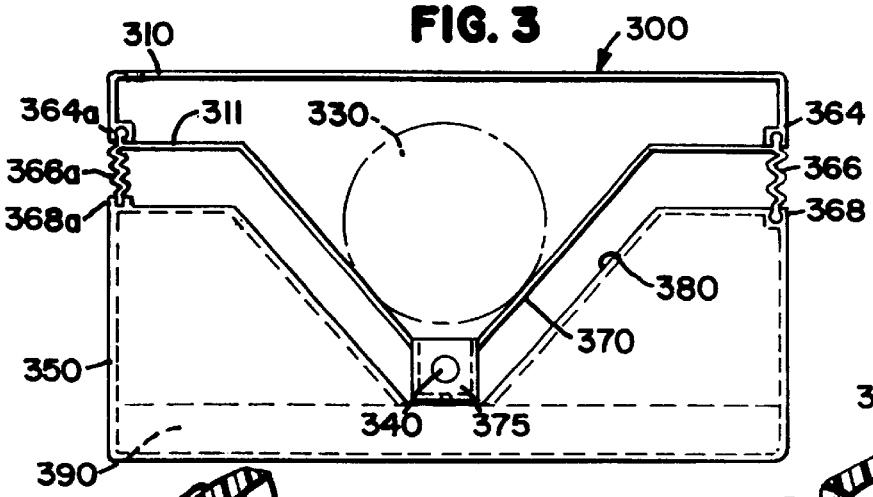
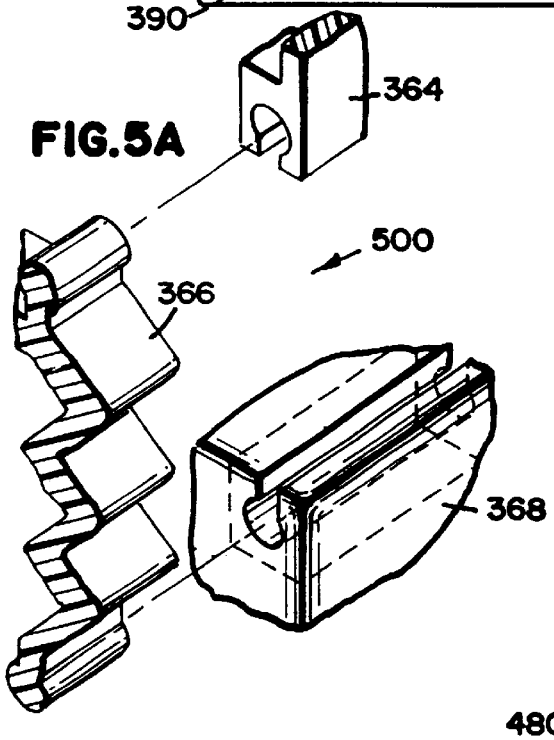
FIG.5A
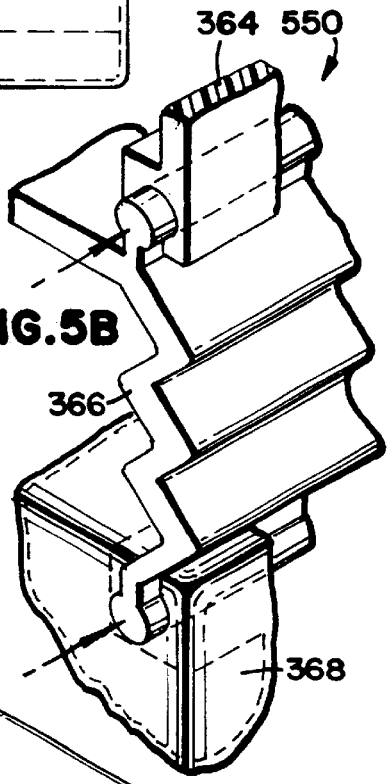
FIG.5B
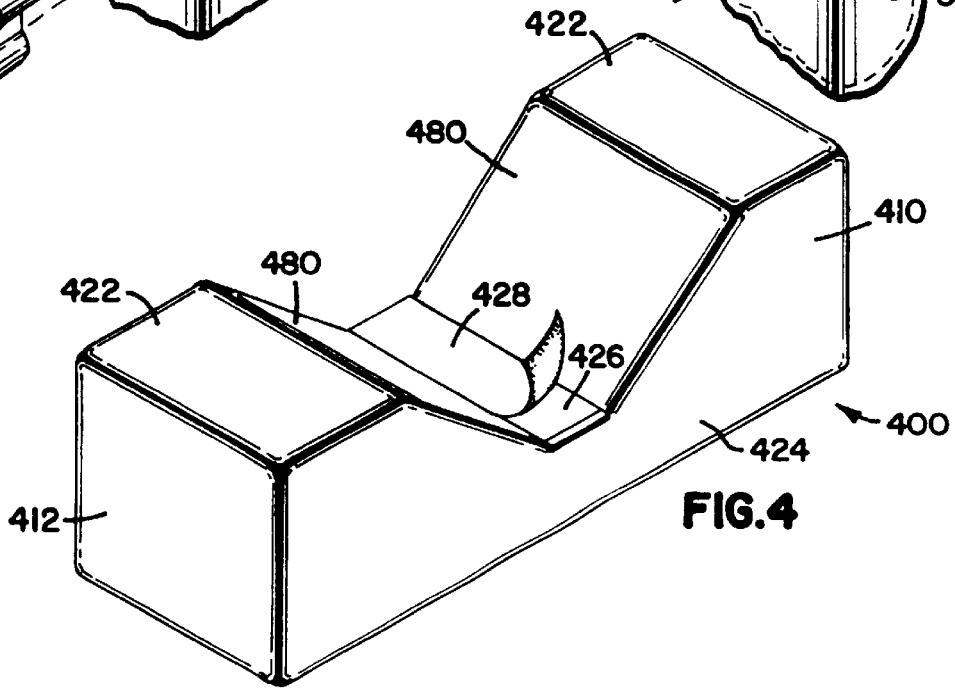
FIG.4

WET OR DRY WEB DISPENSER

This application claims the benefit of U.S. Provisional Application No. 60/112,751 filed Dec. 17, 1998.

FIELD OF THE INVENTION

The invention relates to a dispenser for providing a flexible web, such as a cellulosic, synthetic or blended web, including a bath tissue or personal wipe to a user. The dispenser is capable of providing either a dry web or at the option of the user, providing a wetted web, preferably having a measured amount of an active liquid or liquid treatment material such as a personal care liquid. The invention is directed generally to a device which dispenses a web such as a bath tissue and is directed more specifically to a device which stores a dry web and is capable of dispensing said web dry or in a wetted state containing an intentionally selected liquid based on user needs.

BACKGROUND OF THE INVENTION

A great deal of attention has been directed to the manufacture, use and sale of dispensers that can provide either dry or liquid treated webs including bath tissues, wipes, etc. Typically, such dispensers comprise a container having a useful number of such web articles. The most common are KLEENEX® brand tissues obtained from the familiar box and rolled bath tissue dispensed from wall mounted dispensers. Further, the webs can be dry or treated with a functional liquid. The functional liquid material can be a simple cleaner, maintenance item or a personal care liquid suitable for dermatological contact with an adult, child or infant. Such webs can comprise personal, cosmetic or sanitary wipes, baby wipes, hand wipes, wipes used in car cleaning, household or institutional cleaning or maintenance, computer cleaning and maintenance and any other area in which a flexible wipe having a useful liquid treatment has application. These webs (tissues or wipes) can be made from simple webs, robust webs or treated high strength materials. In use, the user grasps the leading edge of a web material and withdraws sufficient web, in a wetted or dry state, to be used. When the appropriate amount is withdrawn, the web is then obtained individually or is cut, torn at a perforated edge or otherwise severed from the supply.

The prior art recognizes that wetted webs can be provided from a supply of wetted material. Alternately, dispensers can be made by providing apparatus that can apply a treatment liquid to a web which is stored dry. These devices are capable only of dispensing wet web products, as the user does not have the option of choosing between a wet or dry product. Some dispensers use rollers immersed in the treatment fluid to wet the web, or, alternatively, place the rolled web itself within a liquid reservoir. Examples include Kimble, U.S. Pat. No. 4,620,502; and Warren, UK Patent Application No. GB 2168031 A. Other dispensers use a spray to moisten the dry web, including Marceau, U.S. Pat. No. 4,667,846; Carper, U.S. Pat. No. 2,789,725; and Boone, U.S. Pat. No. 3,796,185. Tondelli, UK Patent Specification No. 887,478 discloses a toilet paper dispenser having a spray that can be used to incorporate a liquid treatment onto a rolled web as the web is drawn off a roll.

Watson et al., UK Patent Specification No. 1,370,633 teaches a complex electrically driven mechanism that can be switched on and off to provide a web. The web can be used dry or can optionally be treated with a liquid by a movable mechanism within the device that brings a roll coater upwardly into contact with the moving web as the web is dispensed by the electrical motive members of the dispenser. Tarkkonen, PCT International Publication No. W088/041 (International Application No. PCT/FI86/00146) discloses a tissue paper moistening apparatus having a tissue roll enclosed within a dispenser having a liquid reservoir. The reservoir is connected to a pad that is perforated to provide the liquid. In operation, the apparatus introduces liquid treatment into the pad which, when treatment is desired, is brought into direct liquid transfer contact with the tissue incorporating the liquid into the tissue material. The art discloses additional examples of devices which can dispense either a moistened or dry cellulosic web product at the user's discretion. Many of these involve devices where the dry web passes over a roller which can be moved so as to optionally contact the web with a treatment liquid, thereby providing the user with the option of selecting a wet or dry product.

UK Patent Application No. GB 2045722 A describes a device whereby ordinary toilet tissue may be automatically folded into multilayer pads which can be dispensed either dry or wet at user's option. The pads can be sprayed either with water from a supply line or container or with appropriate medicated fluids and creams provided by a pressurized can or storage container. This device appears to require the user to simultaneously turn a handle to dispense the tissue and depress dispensing means for either water or other treatment fluid. Terepin, U.S. Pat. No. 3,771,883, discloses a device for dispensing a sanitary web in either a dry or lubricated condition. This device has a lubricant contained within a substrate. The device also possesses a diaphragm which permits lubricant to pass from the substrate into the web when the web material is pressed against the diaphragm. Perlman et al., U.S. Pat. No. 3,084,664, discloses a device utilizing a series of rollers to selectively wet toilet paper. This device uses a complicated set of gears and rollers to accomplish its purpose. Other references also teach devices in which the web is selectively wetted by moving rollers in and out of contact with either the liquid itself or a roller immersed in said liquid. Kaczeus, U.S. Pat. No. 3,460,509, describes a complicated set of rollers which may be used to selectively wet the dispensed web. Kaczeus teaches the use of a mechanical path-directing device. Further examples of these include Tusch, U.S. Pat. No. 4,747,365; Garson, U.S. Pat. No. 2,308,168; Browning, U.S. Pat. No. 3,388,953; Pschibul, U.S. Pat. No. 3,363,604; and Fernando et al., U.S. Pat. No. 4,106,433. These teachings include apparatus that can provide a liquid treated web or dry web. However, these apparatus are complex, costly or can result in waste of the liquid treatment material.

The art has experimented broadly with devices that store a dry cellulosic web and then dispense it in a wet condition. As discussed, some can only dispense a wet product, while others have the advantage of selectively dispensing either a wet or dry product. However, due to the complexity (and consequent expense) of these devices, in recent years the art has moved away from such devices and has instead embraced premoistened products. These are products in which the web is stored moist and is dispensed moist. Currently there is a plethora of such products, including baby wipes, hand wipes, wipes intended for computer screens, etc.

For example, Kopacz et al., U.S. Pat. No. 5,540,332, is directed to a wet wipe suitable for use as baby wipes having an improved dispensibility and a method of producing the same. The reference goes on to disclose preferred parameters such as peel force and peel force ratios. Also disclosed are preferred dispensing forces and preferred dispensing force ratios. This is where the art is today-specifically, premoistened wipes and improvements therein. Kaufinan et al., U.S. Pat. No. 4,971,220, is directed to a wet-wipe container with an improved stay-open lid. This is a container which could possibly be used for baby wipes, such as those in the previously discussed reference. Doyle et al., U.S. Pat. No. 4,017,002, discusses a substantially air-tight, cylindrical container containing an elongated web of perforated wet-impregnated, tissue-like material. The web is wound concentrically and is dispensed from the center of the cylinder. The web is dispensed through a resilient slit at the top of the container which opens enough to permit the web to be dispensed but substantially prevents air infiltration otherwise. Thompson, U.S. Pat. No. 4,337,876, discloses a somewhat similar dispensing device. However, Thompson uses a screw-on cap which includes a slitted aperture for dispensing the web while substantially sealing the container. The cap also includes an aperture suitable for holding the free end of the web. Additional evidence of where the state and skill of the art is today is found in Kopacz et al., U.S. Design Patent 385,707, which discloses an ornamental design for the top surface of the paper product. Shown is something similar to a baby wipe, where the design comprises outlined teddy bears on a starred background.

A substantial need in the art continues to exist for a simple mechanism, that obtains motive power from a user, that can provide a dry web or can introduce a liquid treatment onto a web when desired by a user without complicated electrical or mechanical mechanisms. Further, the art shows a substantial need for simple disposable dispensers for a web or a liquid treated tissue web.

BRIEF DISCUSSION OF THE INVENTION

The invention is a dispensing device that allows the user of said device the option of either a coated or dry product from a single web. The device includes a self-contained reservoir for holding a suitable use solution and a separate area for holding the dry web. The dispenser through either gravity, mechanical, immersion or wicking action allows the web to come into contact with the solution. Further, the device can include an adjustable mechanical metering system which controls the amount of solution add-on to the web or meters-off excess treatment during use. The invention is directed but not limited to use with paper and non-woven products. The device has accommodations for a continuous web, a rolled perforated sheet or individually folded sheets and can be designed to fit into existing bath tissue dispensers.

Accordingly, the invention is found in a dispenser of a web, said dispenser capable of providing a dry web or a liquid treated web at a user's option, the dispenser comprising a base container for a liquid treatment, a support structure for the web in a roll form, the support structure having a first dry web providing position and a second liquid treatment web providing position, resilient means biasing the support structure in the first dry web position and operable means to place the support structure in the second liquid treatment web position at the user's option.

In another embodiment, the invention involves a disposable dispenser that can provide a dry web or a liquid containing web at a user's option, the dispenser comprising a liquid reservoir portion and a roll dispenser portion operably connected by a resilient hinge connecting the reservoir portion and the dispenser portion, the roll dispenser portion comprising an apertured insert portion operably conformed to an opening in the liquid reservoir portion such that the insert can enter the aperture and contact the liquid in the reservoir for transfer of liquid to the web, said roll dispenser having a dry web dispensing position and a liquid treated web dispensing position. The dispenser is placed in a liquid web dispensing position by displacing the roll dispenser portion into the liquid reservoir to bring the web into contact with the liquid treatment.

In either embodiment, the device is operated by applying pressure to an upper surface which in turn lowers the roll support and apertured insert holding the tissue into the lower reservoir, thus exposing the tissue to the fluid contained in the reservoir. The tissue is then dispensed by pulling the web from the dispenser. The add-on can be adjusted allowing a desired amount of pressure on the lid roller assembly for metered fluid application or the removal of excess liquid.

Dispenser Materials

The dispenser can be molded of a variety of useful materials, including thermoplastic and thermosetting or composite materials. While metallic elements can be used, polymeric thermoplastic or thermosetting (composite) materials are preferred. Preferably, the dispenser components can be molded in one or more unitary pieces through the use of conventional plastic injection molding, thermoforming, blow molding, etc. techniques. A variety of plastic polymeric materials can be used in fabricating the holder including polyvinyl chloride, polyethylene, polypropylene, polystyrene, acrylonitrile-butadiene-styrene plastics, urethane resins, epoxy resins, nylon resins and others. Preferably, the dispenser comprises a thermoplastic sheet having a thickness of about 0.2 mm or less and comprises a one piece molding. Preferably, the thermoplastic used to create the dispenser comprises polyvinyl chloride, high density polyethylene, polypropylene or mixtures thereof. In the disposable embodiment, the collapsible but resilient corrugated supports comprise a metallic spring, a springed hinge or a resilient serpentine polymeric support.

Suitable Fluids

The wetted web can contain virtually any useful liquid material. Simple liquids such as water, alcohol, solvent, etc. can be useful in a variety of end uses, particularly cleaning and simple wiping applications. Such wipes can be used in hospitals, kitchens, secretarial stations, etc. The wetted webs can also comprise more complex liquids in the forms of solutions, suspensions or emulsions of active materials in a liquid base. In this regard, such solutions can be active materials dissolved in an alcoholic base, aqueous solutions, water in oil emulsions, oil in water emulsions, etc. Such liquids can be cleaning materials, sanitizing materials and personal care materials intended for contact with human skin, hair, nails, etc. Cleaning compositions used generally for routine cleaning operations not involving contact with human skin can often contain a variety of ingredients including, in aqueous or solvent base, a soil-removing surfactant, sequestrants, perfumes, etc. in relatively well-known formulations. Sanitizing wipes can contain a liquid material based on aqueous or alcoholic solutions containing sanitizing materials such as triclosan, hexachlorophene, betadine and other similar materials. Such wipes can also comprise liquids designed for treating or soothing human skin, including moisturizers, cleansing creams and lotions, cleansers for oily skin, deodorants, antiperspirants, baby-care products, sun block, sun screen, cosmetic-removing formula, treated bath wipes, sun block, insect repellent, etc. Moisturizer materials are preparations that reduce water loss or the appearance of water loss from skin. The dryness and reduced flexibility of the skin can be corrected by adding water back into the skin. The skin can be protected and skin dryness prevented or relieved by emollient creams or lotions which can reduce the rate of water evaporation from the outer layers of skin. Cleansing creams or lotions can be developed that can permit the formulation to dissolve or lift away soil pigments, grime and dead skin cells. These creams or lotions can also be enhanced to improve removability of makeup and other skin soils. Cleaners for oily skin are often augmented with ethyl alcohol or isopropyl alcohol to increase the ability of the cleaner to remove excess oily residue. Deodorants and antiperspirants often contain, in an aqueous base, dispersions or emulsions comprising aluminum, zinc or zirconium compounds.

Typical skin treatments that can be applied to the web for both adult and infant use often involve an aqueous base that can contain some alcohol solvent such as ethanol isopropyl, SD alcohol, etc. Such rapidly evaporating bases can also then contain active ingredients such as surfactants, emollients, perfumes and sequestering agents; fatty materials such as oils, lanolin etc.; anti-irritants such as aloe vera gel or glycerin, alpha-hydroxy acids, protein additives, etc. The chemistry and formulation of the treatment liquids is a well-matured and well-understood area of treatment technology.

Preferably the dispenser contains a suitable volume of a treatment liquid comprising either an antimicrobial personal care liquid or a moisturizing skin cleaner liquid. Example formulations of suitable treatment liquids are shown below:

A useful formulation is:

| |
|---|
| water |
| fatty alkyl phosphate |
| glycerin emollient |
| polysorbate 20 surfactant |
| $Na_4$ EDTA |
| DM-DM hydantoin |
| preservative |
| fragrance |

As another example, a formulation is:

| |
|---|
| water |
| SD alcohol 40 |
| propylene glycol |
| aloe vera gel |
| nonoxynol-9 phosphate |
| sorbic acid |
| Oleth-20 |
| fragrance |
| PBG 60 |
| lanolin |

Suitable Tissue Products

The dispenser of the invention can be used to contain, optionally wet and dispense a wide range of tissue products. Cellulosic, synthetic and blended fiber webs can be used. The web dispensed can be as simple as bath tissue, or it can be a cellulosic web having a wet strength additive. Alternately, the dispenser can make use of a web which comprises a robust cellulosic or blended web having a tensile strength of at least 500, preferably 700 grams/foot (gf) or more. The web can be torn or separated to form a useful wipe or tissue using a tearing or cutting edge in the dispenser or by separating the web at a perforated line. If a perforated web is used the tear strength at the perforations should be about 400 to 250 gf.

Wet strength resins can be added to the fiber furnish as desired to increase the wet strength of the final web product. Commonly used wet strength resins belong to the class of polymers termed polyamide-polyamine epichlorohydrin resins. There are many commercial suppliers of these types of resins including Hercules (KYMENE®, Henkel Corp.), FIBRABON® (Borden Chemical), CASCAMIDE® (Georgia Pacific Corp.) and others. These polymers are characterized by having a polyamide backbone containing reactive crosslinking groups distributed along the backbone. Other agents that have been found useful are wet strength agents based on formaldehyde crosslinking of polymeric resins such as urea-formaldehyde and melamine formaldehyde-type wet strength resins. A third class of wet strength resins are the aldehyde derivatives of polyamide resins exemplified by American Cyanamide products known as PAREZ® as well as materials described in U.S. Pat. Nos. 5,085,736, 5,088,344 and 4,981,557 issued to Proctor & Gamble Co. The exact amount of material depends on the specific type of resin, fiber type and forming apparatus used.

The webs of the invention can comprise any known cellulosic or papermaking fibers such as hardwood or softwood fibers. The fibers may be bleached or unbleached and can be produced with any known process such as kraft pulping, sulfite pulping, chemithermomechanical pulping, thermomechanical pulping, or the like. The fibers can be high yield or low yield. Natural cellulosic fibers such as cotton, kenaf, milkweed, and others can be used, as well as chemically modified or synthetically produced cellulosic fibers, including regenerated cellulose fibers. Desirably, the dry weight basis of the web is between 10 and 200 gsm (grams-$m^{-2}$) more specifically between about 15 and 60 gsm, and most specifically between about 15 and 40 gsm. The cellulosic web can be combined with other fibers to form a more robust web with a higher tensile or tear strength. Such fibers can include treated cellulose such as rayon, synthetic fibers such as polyacrylics, polyolephants, polyurethane and others. The blended webs can be woven or nonwoven and can be single-layer, laminated or embossed.

The web may be dried by any known process, and specifically can be a creped tissue dried on a Yankee dryer or can be a creped or uncreped through-dried tissue web. Examples of uncreped through-dried tissue webs include those taught by F. J. Chen et al. in commonly owned U.S. patent application Ser. No. 08/614,420, "Wet Resilient Webs and Disposable Articles Made Therewith;" U.S. Pat. No. 5,429,686, issued to Chiu et al. on Jul. 4, 1995; U.S. Pat. No. 5,399,412, issued to S. J. Sudall and S. A. Engel on Mar. 21, 1995; U.S. Pat. No. 5,672,248, issued to Wendt et al. in Sep. 30, 1997; and U.S. Pat. No. 5,607,551, issued to Farrington et al. on Mar. 4, 1997; all of which are herein incorporated by reference. In several embodiments it is desirable that drying be done by substantially non-compressive methods to preserve the bulk and porosity of the web.

Normal Yankee drying, for example, is compressive, for the wet web is pressed against the Yankee cylinder to dry. Uncreped tissue making processes can use noncompressive drying methods advantageously.

The web can be layered or nonlayered, creped or uncreped, wet pressed or throughdried, preheated, premoistened, and can be single-ply or two-ply or multiply ply. The basis weight of the tissue sheet can be about 10 to 30 grams per square meter per ply. Suitable cellulosic fibers for use in conjunction with the invention include secondary (recycled) paper making fibers and virgin paper making fibers that can be combined in any effective proportion. Such fibers include, without limitation, hard wood and soft wood fibers as well as non-wood derived fibers. Non-cellulosic synthetic fibers can also be included as a portion of the finish. A high quality product having a unique balance of properties can be made using predominantly secondary fibers or all secondary fibers. The finished basis weight of the individual sheets or plies of tissue used for the purpose of the invention can preferably be from about 10 to about 30 grams per square meter per ply. Either before or after embossing, the sheets can be plied together to form multiplied products having two, three, four or more plies.

The Embodiments

The first embodiment involves a dispenser of a web, said dispenser capable of providing a dry web or a liquid treated web at the user option, the dispenser comprising a base container for a liquid treatment, a support structure for the web in a roll form, the support structure having a first dry web providing position and a second liquid treatment web providing position, resilient means comprising a helical spring biasing the support structure in the first dry web position and operable means to place the support structure in the second liquid treatment web position at the user option. In the second position, the support structure contacts the liquid and the structure comprises means to permit contact between the web and the treatment.

In this dispenser, the support structure comprises an enclosure for the roll web, preferably comprising a perforated surface that comes into contact with the liquid treatment in the second liquid treatment web providing position. The container for the liquid treatment comprises a container having an opening that conforms to a portion of the support structure such that the support structure can penetrate the opening in such a way that the support structure and the perforated surface is immersed in the treatment liquid. The support structure in the second position seals the opening such that the treatment liquid can exit the container only through a perforation in the support structure. The support structure preferably comprises a V-shaped structure complementary in shape to the container while the container has an upper surface complimentary with the V-shaped support structure. Further, the support structure additionally comprises metering means to gauge the liquid add-on or to remove excess fluid from the liquid treated web. The web must have sufficient tensile strength when wet to permit easy withdrawal from the dispenser.

An alternative embodiment involves disposable dispenser that can provide a dry web or a liquid containing web at a user's option, the dispenser comprising a liquid reservoir portion and a roll dispenser portion operably connected by a resilient hinge connecting the reservoir portion and the dispenser portion, the roll dispenser portion comprising an apertured insert portion operably conformed to an opening in the liquid reservoir portion such that the insert can enter the aperture and contact the liquid in the reservoir for transfer to the web, said roll dispenser having a dry web dispensing position and a liquid treated web dispensing position, wherein the dispenser is placed in a liquid web dispensing position by displacing the roll dispenser portion into the liquid reservoir to bring the roll into contact with the liquid treatment.

This dispenser comprises a thermoplastic sheet having a thickness of about 0.2 millimeter or less comprising a one piece molding and preferably comprises polyvinyl chloride, high density polyethylene, polypropylene or mixtures thereof. Alternatively, the dispenser can comprise a two piece molding. The dispenser contains a treatment liquid comprising an antimicrobial personal care liquid or comprises a moisturizing skin cleaner liquid. The roll dispenser and the liquid reservoir have complimentary surfaces, wherein the liquid reservoir is scaled with a tear-off strip prior to use. Preferably, the dispenser contains a web comprising either a bath tissue or a cellulosic web having a wet strength additive. Alternatively, the web comprises a robust cellulosic web having a tensile strength of at least 750 gf.

DETAILED DISCUSSION OF THE DRAWINGS

FIG. 1 generally shows a dispenser 100 including an upper tray lid 110 and attached upper tray 111 suitable to hold a rolled cellulosic wed 130 and a lower tray 150 capable of holding a useful volume of a liquid web treatment fluid. The wed 130 rests on two sloped planes 170 of the upper tray 110. Two pairs of braces 120 (shown in phantom) serve to attach the upper tray lid 110 to the upper tray 111. Seen at the bottom of upper tray 111 is a square portion 175 which serves to locate a roller 140.

The upper tray 111 is held in position relative to lower tray 150 by two pairs of spring posts 160 and springs 162. The springs 162 are sized as to be in compression, which serves to bias the upper tray 111 and lower tray 150 in a first dry web providing position when no external force is applied. Lower tray 150 holds a volume of fluid 190 and has a pair of sloped upper planes 180 complementary to the lower sloped planes 170 of the upper tray 111. This complementary V-shaped geometry allows the sloped planes 170, used to hold the cellulosic wed 130, to come in close proximity to the sloped planes 180 when the device is in compression. Finally, FIG. 1 shows the terminal or free end 132 of the cellulosic wed 130, exiting through slot 112 when withdrawn by the user.

FIG. 2 is a cross-sectional front view 200 of the dispenser of FIG. 1, taken along the 2—2 line. More specifically, this shows the dispenser in compression, which serves to wet the wed 130 as it is dispensed by holding the web in a second liquid treatment position. In FIG. 2, upper tray lid 110 is shown in phantom in the uncompressed position. When downward force is applied to the top surface of upper tray lid 110, springs 162 are compressed and upper tray lid 110 and attached upper tray 111 moves downward, placing the square portion 175 of the upper tray 111 and the roller 140 into the fluid 190, in close proximity to the lower tray 150. FIG. 2 also shows the path taken by the wed 130. In this particular view, the wed 130 unrolls clockwise, travels around the submerged roller 140 and exits the dispenser as terminal or free end 132 through slot 112 (not seen in this Figure.) Also generally seen in FIG. 2 are the spring posts 160 and the braces 120.

FIG. 3 is a cross-sectional front view 300 of an alternative embodiment dispenser. This embodiment is similar to that shown in FIGS. 1 and 2, but differs in how the upper tray 310 moves in relation to the lower tray 350. Specifically, this is a disposable dispenser in which downward force on the top surface of upper tray lid 310 serves to crumple a pair of corrugated inserts 366 and **366*a*. Insert 366 is shown on the right side of FIG. 3. snapped into portion 364 of the upper tray 311 and portion 368 of the lower tray 350. Conversely, insert 366*a* is shown on the left side of FIG. 3, snapped into portion 364*a* of the upper tray 311 and portion 368*a* of the lower tray 350. As with FIGS. 1 and 2, FIG. 3 shows a rolled cellulosic web 330 and a roller 340. The upper tray 311 has a pair of sloped lower planes 370 which complement a pair of sloped upper planes in the lower tray 350. As before, the lower tray 350 carries a volume of fluid 390**.

FIG. 4 is a perspective view 400 of the lower tray 410 of the invention, generally showing a front face 424 and an end face 412. Also seen are horizontal faces 422 and sloped planes 480. The important part of this figure comprises aperture 426 and sealable tape 428.

FIG. 5*a* is an exploded view 500 of a portion of FIG. 3, which shows in some detail the collapsible connections between upper and lower trays. Shown is the corrugated collapsible connector 366, which slides into portion 364 of the upper tray and portion 368 of the lower tray.

FIG. 5*b* is a condensed view 550 of FIG. 5*a*, which shows the corrugated collapsible connector 366 attached to portion 364 of the upper tray and portion 368 of the lower tray.

FIG. 6*a* is an exploded view 600 which shows in some detail the collapsible connections between upper and lower trays. Shown is an alternative corrugated collapsible connector 366*a* , which slides into portion 364*a* of the upper tray and portion 368*a* of the lower tray.

Figure 6B:
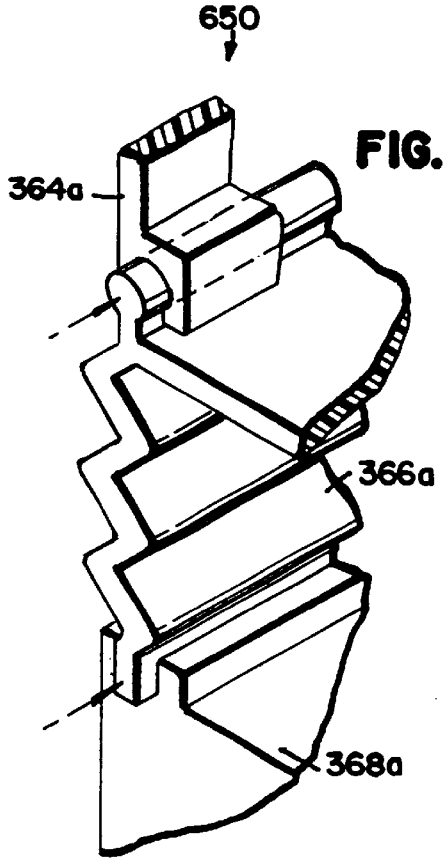

FIG. 6*b* is a condensed view 650 of FIG. 6*a* , which shows the corrugated collapsible connector 366*a* attached to portion 364*a* of the upper tray and portion 368*a* of the lower tray.

FIGS. 5*a*, 5*b*, 6*a* and 6*b* collectively demonstrate a possible means of assembling the disposable dispenser of the invention. FIGS. 5*a* and 5*b* show how the collapsible connector 366 can slide horizontally into upper tray portion 364 and lower tray portion 368. The upper tray can pivot on connector 366. Then, connector 366*a* can slide horizontally into upper tray portion 364*a*. The bottom end of connector 366*a* is shaped such that it can drop vertically into lower tray portion 368*a*.

The above specification provides a complete description of the manufacture and use of the structure of the invention. Since many embodiments of the invention can be made without departing from the spirit and scope of the invention, the invention resides in the claims hereinafter appended.

We claim:

1. A dispenser of a web, said dispenser capable of providing a dry web or a liquid treated web at a user's option, the dispenser comprising a base container for a liquid treatment, a support structure for the web in a roll form, the support structure having a first dry web providing position and a second liquid treatment web providing position, resilient means biasing the support structure in the first dry web providing position and operable means to place the support structure in the second liquid treatment web providing position at the user's option, wherein the support structure comprises an enclosure for the web in roll form having a perforated surface that comes into contact with the liquid treatment in the second liquid treatment web providing position.

2. The dispenser of claim 1 wherein the resilient means comprises a helical spring.

3. The dispenser of claim 1 wherein the support structure additionally comprises metering means to remove excess liquid treatment from a liquid treated web.

4. The dispenser of claim 1 wherein the web comprises a cellulosic web having sufficient tensile strength to be withdrawn from the dispenser as a wet treated web.

5. A disposable dispenser that can provide a dry web or a liquid containing web at a user's option, the dispenser comprising a liquid reservoir portion and a roll dispenser portion operably connected by a resilient hinge connecting the reservoir portion and the roll dispenser portion, the roll dispenser portion comprising an apertured insert portion operably conformed to an opening in the liquid reservoir portion such that the insert can enter the aperture and contact a liquid in the liquid reservoir portion for transfer to the web, the roll dispenser portion having a dry web dispensing position and a liquid treated web dispensing position, wherein the dispenser is placed in the liquid web dispensing position by displacing the roll dispenser portion into the liquid reservoir portion to bring the web into contact with the liquid.

6. The dispenser of claim 5 wherein the dispenser comprises a thermoplastic sheet having a thickness of about 0.2 millimeter or less comprising a one piece molding.

7. The dispenser of claim 6 wherein the thermoplastic sheet comprises polyvinyl chloride, high density polyethylene, polypropylene or mixtures thereof.

8. The dispenser of claim 5 wherein the liquid is an antimicrobial personal care liquid.

9. The dispenser of claim 5 wherein the liquid comprises a moisturizing skin cleaner liquid.

10. The dispenser of claim 5 wherein the roll dispenser portion and the liquid reservoir portion have complimentary surfaces.

11. The dispenser of claim 5 wherein the liquid reservoir portion is sealed with a tear-off strip prior to use.

12. The dispenser of claim 5 wherein the web comprises a bath tissue.

13. The dispenser of claim 5 wherein the web comprises a cellulosic web having a we t strength additive.

14. The dispenser of claim 5 wherein the web comprises a robust cellulosic web having a tensile strength of at least 700 gf.

15. The dispenser of claim 5 wherein the dispenser comprises a thermoplastic sheet having a thickness of about 0.2 millimeter or less comprising a two piece molding.

16. A dispenser of a web, said dispenser capable of providing a dry web or a liquid treated web at a user's option, the dispenser comprising a base container for a liquid treatment, a support structure for the web in a roll form, the support structure having a first dry web providing position and a second liquid treatment web providing position, resilient means biasing the support structure in the first dry web position and operable means to place the support structure in the second liquid treatment web position at the user's option, wherein the container for the liquid treatment comprises a container having an opening that conforms to a portion of the support structure such that the support structure can penetrate the opening in such a way that the support structure is immersed in the liquid treatment when the support structure is in the second liquid treatment web providing position.

17. The structure of claim 16 wherein the support structure in the second liquid treatment web providing position seals the opening such that the liquid treatment can exit the container only through a perforation in the support structure.

18. A dispenser of a web, said dispenser capable of providing a dry web or a liquid treated web at a user's option, the dispenser comprising a base container for a liquid treatment, a support structure for the web in a roll form, the support structure having a first dry web providing position and a second liquid treatment web providing position, resilient means biasing the support structure in the first dry web providing position and operable means to place the support structure in the second liquid treatment web providing position at the user's option, wherein the support structure comprises a V-shaped structure support complementary to the container and immersible in the liquid treatment when the support structure is in the second liquid treatment web providing position.

19. The dispenser of claim 18 wherein the container has an upper surface complementary with the V-shaped support structure.

* * * * *